US007317176B2

(12) United States Patent
Boucher

(10) Patent No.: US 7,317,176 B2
(45) Date of Patent: Jan. 8, 2008

(54) PORTABLE HEATED FOOTREST

(76) Inventor: Laura Boucher, 4 Hunter Dr., Epping, NH (US) 03042

( * ) Notice: Subject to any disclaimer, the term of this patent is extended or adjusted under 35 U.S.C. 154(b) by 449 days.

(21) Appl. No.: 10/981,983

(22) Filed: Nov. 5, 2004

(65) Prior Publication Data

US 2006/0108852 A1 May 25, 2006

(51) Int. Cl.
*H05B 3/02* (2006.01)
*A47C 16/00* (2006.01)

(52) U.S. Cl. ..... 219/546; 297/423.4; 297/423.41; 297/217.3; 297/180.12; 5/421; 5/423

(58) Field of Classification Search ..... 219/546; 297/421, 423.41, 217.3, 180.12, 180.11; 5/421, 423
See application file for complete search history.

(56) References Cited

U.S. PATENT DOCUMENTS 5,588,161 A * 12/1996 Barradas ..... 4/662
6,799,804 B1 * 10/2004 Fournier ..... 297/423.41

* cited by examiner

*Primary Examiner*—Shawntina Fuqua
(74) *Attorney, Agent, or Firm*—Lawson & Persson, P.C.; Michael J. Persson

(57) ABSTRACT

A portable footrest including a foot platform having a top surface and a bottom surface and a heater in thermal communication with the bottom surface. A housing is disposed in supporting relation to the foot platform and the heater. The housing is shaped and dimensioned to maintain the foot platform and the heater above a level of a surface upon which the footrest is placed. An electronic assembly is in electrical communication with the heater. The electronic assembly includes an electrical connector for connection to an power source, means for manually energizing and de-energizing the heater, and means for automatically de-energizing the heater.

24 Claims, 11 Drawing Sheets

PORTABLE HEATED FOOTREST

FIELD OF THE INVENTION

The present invention generally relates to the field of warming devices and, in particular, to portable indoor devices for warming the lower extremities of a human.

BACKGROUND OF THE INVENTION

Heated air rises. While this thermal property often provides the driving force behind many useful machines, it is a frequent nuisance for those indoors. A person sitting in a chair in the average heated room will have warmer air around her face than around her feet. The face, as is true with all extremities, is more sensitive to temperature than more central parts of the body and, therefore, it is important to warm the face. However, it is also important to warm the feet.

Cold feet hurt. Before efficient area heating became common practice or feasible, inventors created apparatus specifically to warm the feet. Until the turn of the 20th century, for example, it would not be an uncommon sight to see a buggy-rider carrying a large soapstone to her car. The rider that foresaw a cold journey would take this soapstone and preheat it by fire. She would then wrap a towel around the soapstone and maneuver it onto the floor of her car. To one in the age of central heating and air, this seems awkward; but for centuries this was the state of the art, and worked reasonably well. Soapstone possesses extraordinary heating properties: it stores more heat for its weight than any other naturally occurring material, holding twice the heat-storing capacity of iron. Additionally, unlike steel and other metals, soapstone can withstand great fluctuation in temperature with little expansion or contraction. Despite all of soapstone's virtues, it is a stone and, consequently is heavy, bulky, and must be preheated to allow for subsequent heat release.

Some early homes included soapstone foot warmers, but most generally utilized wood-burning fireplaces for heat. The basic version of the wood-burning stove includes a wood stand within a large cavity of a room and some means for allowing smoke to exit. Burning wood is not a particularly efficient way to heat a room. Wood does not always burn evenly, and the resulting heat does not reach the furthest corners of large rooms. Power-driven temperature control units began to replace the wood-burning fireplaces.

Eventually power-driven temperature control units became a common sight in the American home. The most common power-driven temperature control units include air conditioners, heat pumps, fans and furnaces. These power-driven temperature units, however, share a common flaw with wood-burning fireplaces: fixed outputs. Each normal temperature controlled room typically has one, sometimes more, outputs fixed into the floor, wall, or ceiling. A single fixed output creates a variable temperature environment characterized by a higher temperature close to the output and at higher points in a room, and a lower temperature farther from the output and at lower points of a room. Additionally, the fixed nature of the output results in a room with contents arranged to suit the location of the output. Organizing furniture to optimize warmth in a room is cumbersome. It is more convenient to bring the warmth to the furniture, not the furniture to the warmth.

Currently, the most prominent scheme of bringing warmth to a particular spot is by a portable space heater. Space heaters blow air circulated over electric resistance heating elements. Space heaters work well; they are typically lightweight, use alternating current, heat quickly, and can fit into small places. When a person is at a desk some substantial distance from a heat output and has cold feet, she will often employ a space heater to provide warmth. Though good at heating, space heaters have significant drawbacks.

First, the heating coils act to remove moisture from the air, drying skin and aggravating winter coughs. Preferably, a device used to comfort the feet should not simultaneously damage them. Second, space heaters pose a number of dangers to the user. For example, the air outlets of many space heaters become extremely hot and can cause combustion of carpets, papers or other combustible materials if the heater is tipped over. In fact, the instructions of most space heaters direct the user to keep the heater off of carpeting and at least three feet from draperies, blankets, sofas and other such potential tinder, and are warned not to go to sleep or leave the heater untended without turning it to low, or better yet, off. As current space heaters do not include any automatic shutoff feature, and as employees have been known to forget to turn them off, many places of business forbid the use of space heaters at the desks of employees. In addition to the risk of fire, the outlet and the hot coils used to heat the air can burn the skin of a person using it were this skin to come in contact with the outlet. Further, although some heaters have guards designed to prevent access to the elements, little fingers may nevertheless maneuver through them. Consequently, space heaters do not provide an ideal solution to the problem of heating the lower extremities.

Another current method for warming the feet is to use an insulated rubber mat, such as those sold by Indus Tool of Chicago, Ill., under the trademark "COZY FOOT-WARMER". These foot warmers utilize a resistance heater that is encapsulated within a rubber mat material that is placed in the floor beneath the user. Accordingly, they eliminate the risk of burning the user and do not dry the ambient air in the same manner as conventional space heaters. Unfortunately, these products also have significant drawbacks. First, because rubber is an insulating material, the heating elements within the rubber mat must produce a much higher heat, and will take a significant period of time, to heat the surface of the mat to a temperature sufficient to provide the necessary degree of comfort to the user. This increased heater output results in higher power consumption and a greater risk of shorting. In addition, the need to place the rubber mat on the floor places the electrical connections in direct contact with carpeting. This is a significant drawback both because the carpeting can ignite should a short circuit occur, and because this arrangement exposes the connections to any flooding or other dampness present in the carpet, which can cause the unit to short circuit. These heaters also do not include an automatic shut off feature, which poses the same drawbacks inherent in current space heaters. Finally, the need to lay these units flat on the ground requires that the user's feet likewise be placed in a flat position, which is not ergonomically correct and can cause posture problems after extended use.

Finally, a number of other foot warmers take the form of heated footrests. These devices, such as those sold by Indus Tool of Chicago, Ill., under the trademark "COZY FOOT-REST", those sold by McGill under the name "Deluxe Personal Foot Warmer" and those sold by Holmes under the name "Foot Warmer", each include a plastic platform that includes a resistance heater and a means for disposing the platform at an angle. Therefore, each of these units allows the user to place their feet at an ergonomically correct position and removes the electrical components from direct contact with carpeting. However, these units all use relatively small resistance heaters, which do not cover a substantial portion of the bottom surface of the foot platform and require the heat to be spread via conduction through the foot platform. This need for conduction, coupled with the use of insulating materials in the platform, creates the same power loss and long heat-up time inherent in the mat heater discussed above and creates hot spots on the surface of the foot platform. Further, none of these units includes an automatic shutoff feature.

Therefore, there is a need for a portable heating footrest that can be safely placed near skin and electrical equipment; is lightweight; utilizes alternating current as a power source; fits under a desk, table, chair or the like, is comfortable; does not cause skin dryness; does not place the electrical connections in contact with the floor; allows the user to place their feet in an ergonomically correct position; does not utilizes a foot platform manufactured of a poor thermally conductive material that requires the heater to have a high power output or take a significant period of time to heat-up; that substantially uniformly heats the foot platform, and that includes an automatic shutoff feature to prevent the heater from running when left unattended.

SUMMARY OF THE INVENTION

The present invention is a portable heated footrest. One basic embodiment of the portable footrest includes a foot platform having a top surface and a bottom surface and a heater in thermal communication with the bottom surface. A housing is disposed in supporting relation to the foot platform and the heater. The housing is shaped and dimensioned to maintain the foot platform and the heater above a level of a surface upon which the footrest is placed. Finally, an electronic assembly is in electrical communication with the heater. The electronic assembly includes an electrical connector for connection to a power source, such as a household electrical outlet, means for manually energizing and de-energizing the heater, and means for automatically de-energizing the heater.

In a preferred embodiment, the footrest includes a foot sensor in electrical communication with the electronic assembly. The foot sensor has a means for sensing a foot disposed upon the foot platform and output means for sending an output signal to the means for automatically de-energizing the heater when the foot is not disposed upon the foot platform. In such embodiments, the means for automatically de-energizing the heater preferably includes a microprocessor programmed to automatically de-energize the heater when the foot is not disposed upon the foot platform for a predetermined period of time. The preferred foot sensor is at least one optical sensor oriented across a plane formed by the foot platform so as to sense the presence of a foot thereon. However, the foot sensor may take many forms, including a pressure sensor in communication with the foot platform and adapted to sense an increase in pressure upon the foot platform.

The preferred means for manually energizing and de-energizing the heater is a foot actuatable switch. The preferred embodiment also includes a means for adjusting a temperature of the foot platform, which preferably takes the form of a first foot actuatable switch for increasing the temperature of the foot platform and a second foot actuatable switch for decreasing the temperature of the foot platform.

The housing of the preferred footrest also includes a means for adjusting an angle of the foot platform. The preferred means for adjusting an angle of the foot platform is a series of screw holes or slots disposed within the bottom of the housing into which the riser is attached. In this arrangement, attaching the riser closer to the front of the housing increases the angle of the foot platform while attaching the riser closer to the rear of the housing decreases the angle of the foot platform. However, other embodiments utilized other art recognized means for adjusting this angle.

The preferred foot platform is a substantially rectangular sheet of a thermally conductive metal material, such as aluminum, having a thickness of less then 0.375 inches and an electrically insulating coating disposed upon the top surface thereof. The preferred heater is a flexible heater having a thickness of less then 0.25 inches, and is dimensioned to cover at least fifty percent of the bottom surface of the foot platform.

An alternative embodiment of the footrest includes a foot platform manufactured of a thermally conductive material and an electrical resistance heater in thermal communication with the bottom surface of the foot platform. The electrical resistance heater has a thickness of less then 0.25 inches and is dimensioned to cover at least fifty percent of the bottom surface of the foot platform. A housing is disposed in supporting relation to the foot platform and the electrical resistance heater and is shaped and dimensioned to maintain the foot platform and the electrical resistance heater above a level of a surface upon which the footrest is placed. The electronic assembly of this embodiment is in electrical communication with the electrical resistance heater and includes an electrical connector for connection to a power source and means for energizing and de-energizing the heater.

Other variations of the alternative footrest may include one or more of the foot sensor, temperature control and other features discussed in detail above.

Therefore, it is an aspect of the present invention to provide a portable heating footrest that can be safely placed near skin and electrical equipment.

It is a further aspect of the present invention to provide a portable heating footrest that is lightweight.

It is a further aspect of the present invention to provide a portable heating footrest that utilizes alternating current as a power source.

It is a further aspect of the present invention to provide a portable heating footrest that fits under a desk, table, chair or the like.

It is a further aspect of the present invention to provide a portable heating footrest that is comfortable.

It is a further aspect of the present invention to provide a portable heating footrest that does not cause skin dryness.

It is a further aspect of the present invention to provide a portable heating footrest that is safer to use than current space heaters and heated footrests.

It is a further aspect of the present invention to provide a portable heating footrest that heats quickly.

It is a further aspect of the present invention to provide a portable heating footrest that does not place the electrical connections in contact with the floor.

It is a further aspect of the present invention to provide a portable heating footrest that allows the user to place their feet in an ergonomically correct position.

It is a further aspect of the present invention to provide a portable heating footrest that does not utilize a platform manufactured insulating material that requires the heater to have a high power output.

It is a further aspect of the present invention to provide a portable heating footrest in which the foot platform is heated to a substantially uniform temperature.

It is a still further aspect of the present invention to provide a portable heating footrest that includes an automatic shutoff feature to prevent the heater from running when left unattended.

These aspects of the invention are not meant to be exclusive and other features, aspects, and advantages of the present invention will be readily apparent to those of ordinary skill in the art when read in conjunction with the following description, and accompanying drawings.

DETAILED DESCRIPTION OF THE INVENTION

Figure 1:
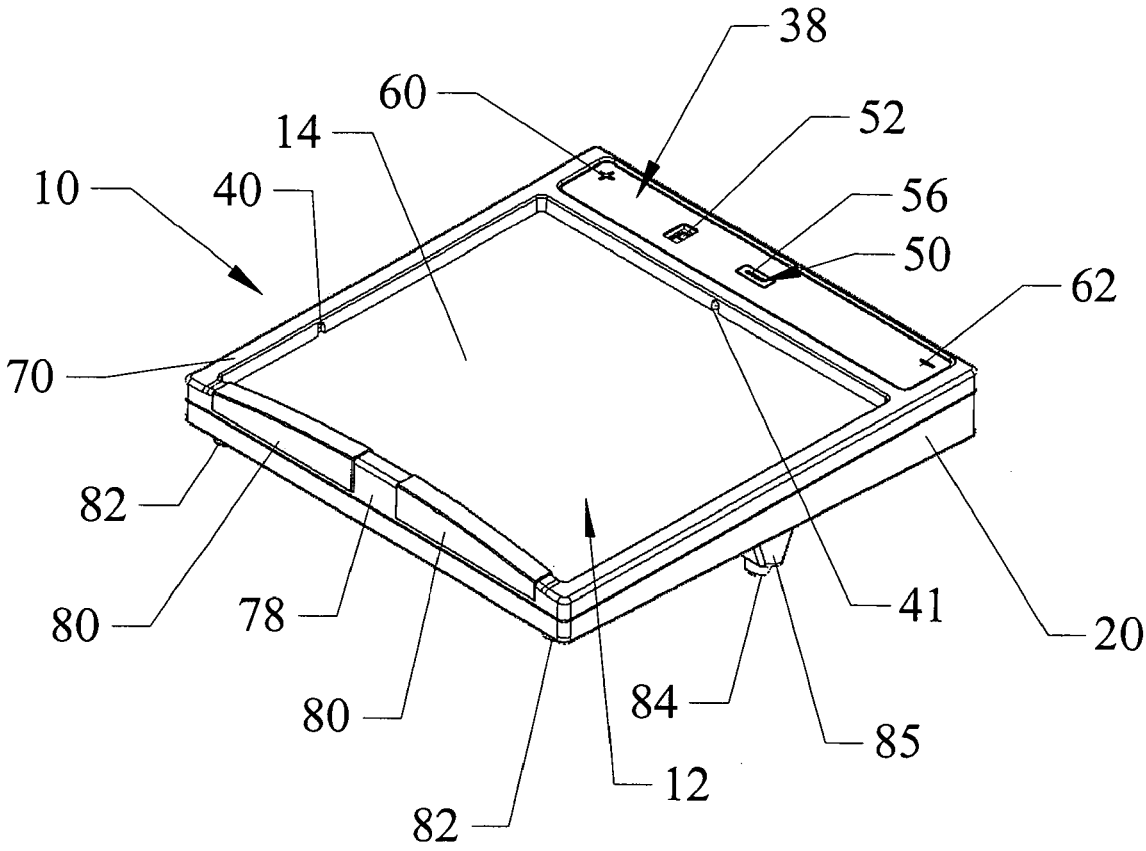
FIG. 1 is an isometric view of the preferred embodiment of the footrest of the present invention.
Figure 2:
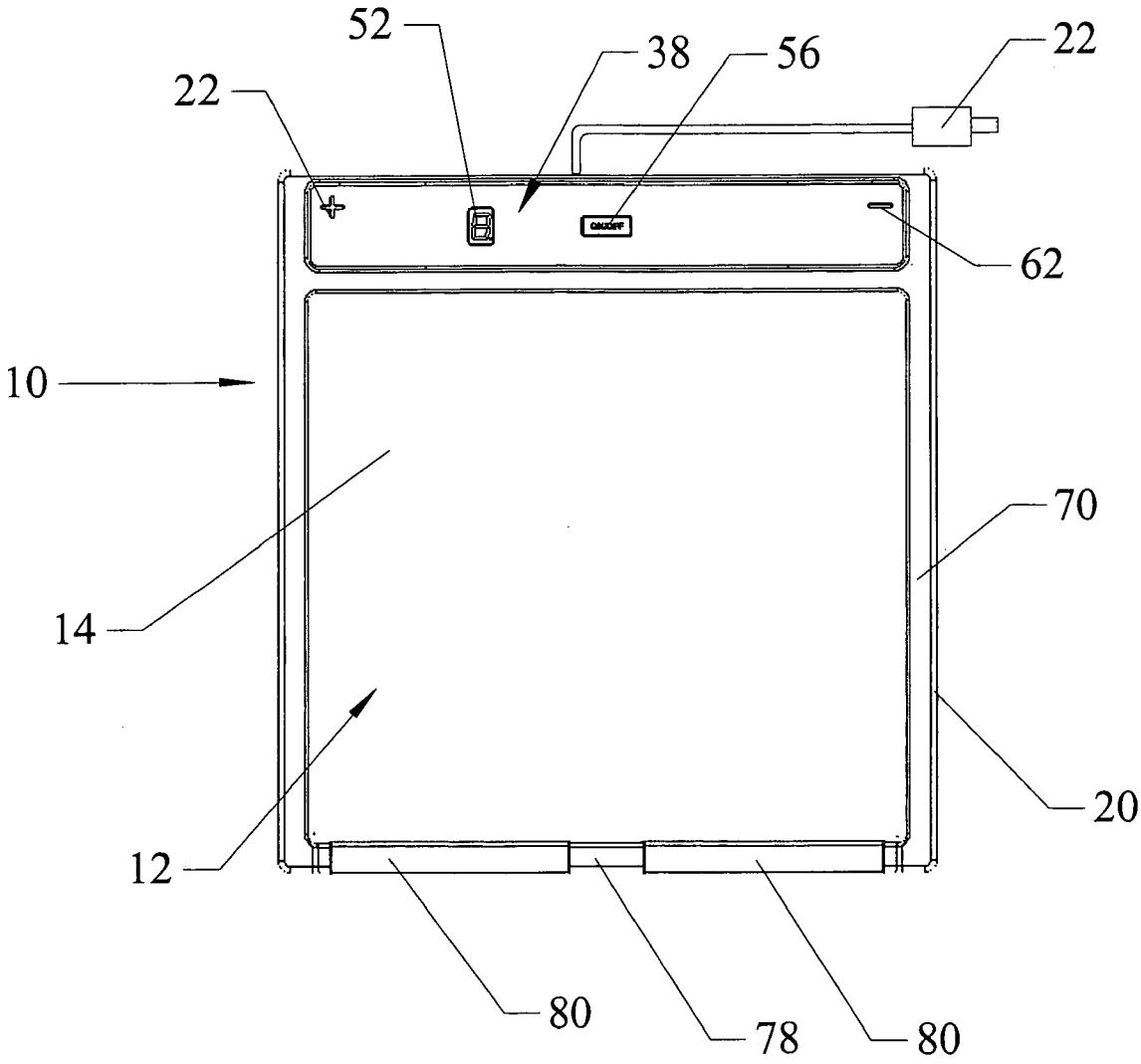
FIG. 2 is a top view of the preferred embodiment of the footrest of the present invention.

Referring to FIGS. 1-4, the preferred embodiment of the portable footrest 10 of the present invention is shown. The portable footrest 10 includes a foot platform 12 having a top surface 14 and a bottom surface 16. A heater 18 is attached to the foot platform 12 and disposed in thermal communication with the top surface 14 thereof. A housing 20 is disposed in supporting relation to the foot platform 12 and acts to enclose the heater 18. An electronic assembly 22 is disposed in electrical communication with the heater 18 and includes an electrical connector 24 for connection to a power source (not shown), means for manually energizing and de-energizing the heater 18, and means for automatically de-energizing the heater 18.

The top surface 14 of the foot platform 12 is dimensioned to accommodate a pair of human feet and is preferably manufactured of a material having good thermal conductivity. In the preferred embodiment, the foot platform 12 is manufactured from a sheet of aluminum due to its relatively low weight and good thermal spreading capabilities. For aesthetic reasons, the top surface 14 of the preferred foot platform 12 is preferably powder coated with a thin layer of a polymeric material, which resists scratching and abrasion. However, other embodiments using aluminum foot platforms 12 may be anodized, chromate washed or epoxy painted in order to finish the surface, while still others have no surface finish, which allows the top surface 14 to oxidize.

Figure 4A:
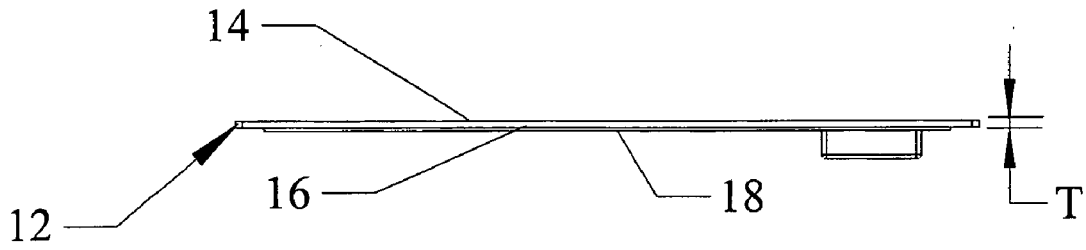
FIG. 4A is a side view of the foot platform of the preferred footrest showing the preferred electrical resistance heater attached thereto.
Figure 4B:
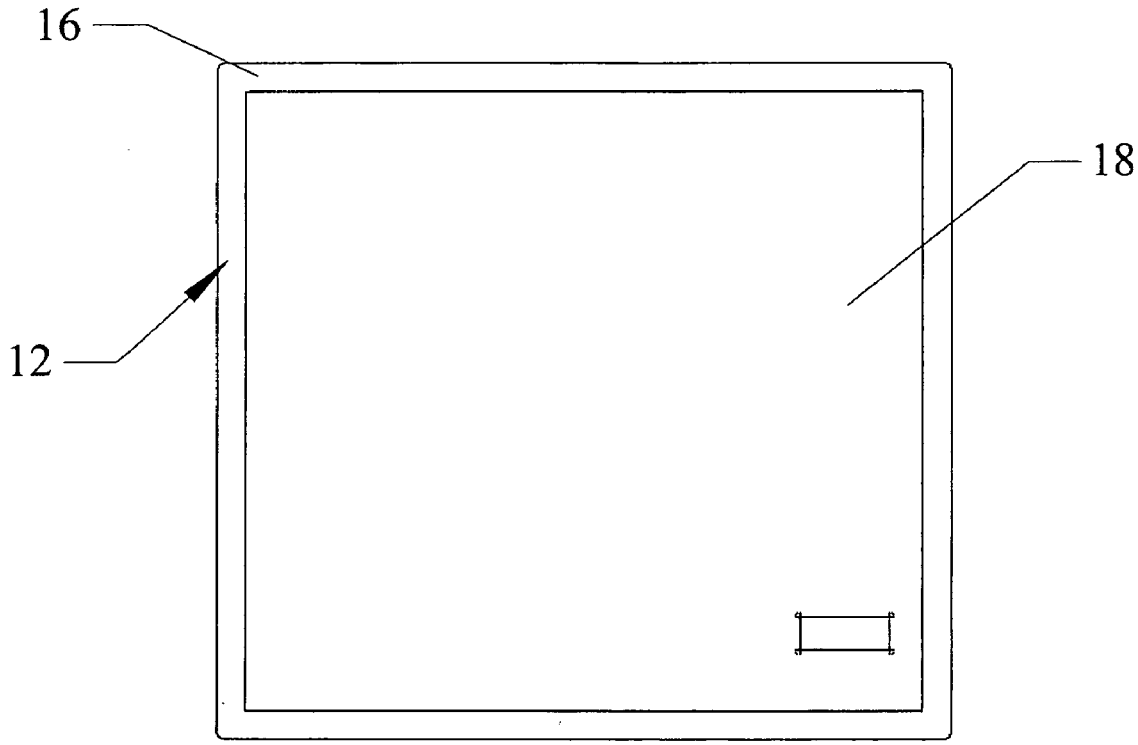
FIG. 4B is a bottom view of the foot platform of FIG. 4A.

As shown in FIGS. 4A and 4B, the preferred foot platform 12 is relatively thin, and has a thickness T that is less than 0.25 inches. Similarly, the heater 18 is a sheet style electrical resistance heater, such as those manufactured by Electro-Flex Heat, Inc., of Bloomfield, Conn., in which etched foil heating elements are encapsulated within an insulating material, such as silicone rubber or KAPTON®/FEP. The preferred resistance heater 18 has a thickness of less than 0.025 inches, excluding the power connector 30.

This preferred heater 18 is adhered to the bottom surface 16 of the foot platform 12, either via a thermally conductive adhesive or direct vulcanization thereto, and covers at least fifty percent (50%) of the bottom surface 16. Heating a large percentage of the foot platform 12 eliminates many of the thermal conduction losses common in other prior art designs and allows the thickness T of the foot platform 12 to be made extremely thin, i.e. as low as 0.020 inches, and to be manufactured of materials, such as plastics, that have lower thermal conductivities, while maintaining a substantially uniform temperature across the top surface 14 thereof. However, it should be recognized that other embodiments of the present invention may include foot platforms 12 manufactured of thicker materials and/or use other types of heaters, such as cartridge heaters embedded within the foot platform 12, or heating tape, or the like, disposed upon smaller percentage of the bottom surface 16 of the foot platform 12. Accordingly, all embodiments of the footrest 10 should not be seen as being so limited.

In some embodiments, the heater 18 is a thermoelectric heating/cooling module that allows the footrest to be operated in heating and cooling mode. In embodiments utilizing a thermoelectric module, the preferred heater is a model PT4-12-40 manufactured by Melcor Corporation of Trenton, N.J. In such an embodiment, one side of the heater 18 is mounted in conductive relation to the bottom surface 16 of the foot platform 12 and the footrest 10 is operated in heating mode by flowing direct current in one direction through the module and used in cooling mode by reversing the flow of current. The ability to heat and cool the foot platform 12 allows the footrest 10 to be utilized in both the winter months, when feet are cold, and in summer months, when the user's feet may be hot and sticky, and the inventor believes that a footrest utilizing such a module is one unique aspect of the invention. However, despite the advantage of versatility, this embodiment is not preferred due to the higher relative cost and decreased efficiency of thermoelectric modules when compared to electrical resistance heaters.

Figure 3:
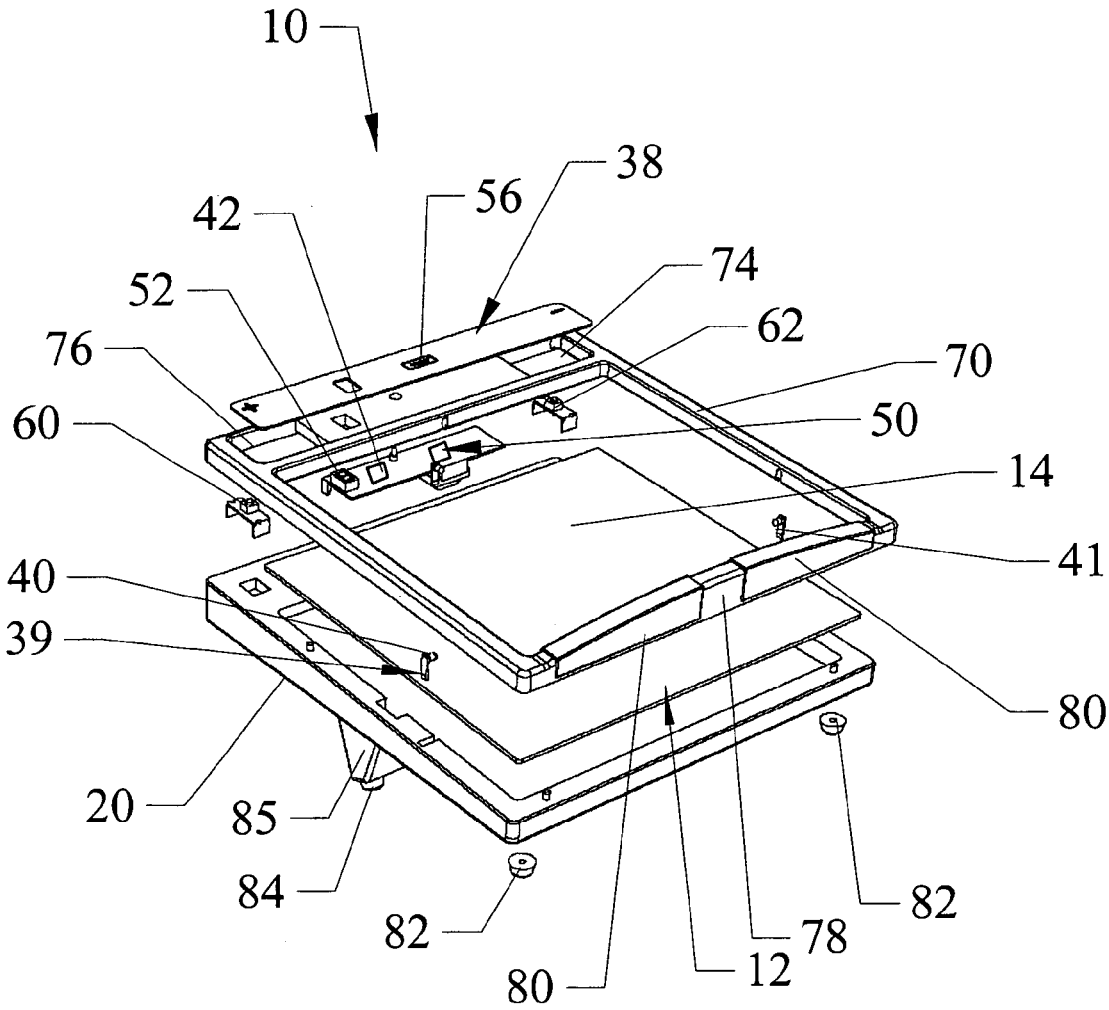
FIG. 3 is an assembly view of the preferred embodiment of the footrest of the present invention.

As shown in detail in FIG. 3, the electronic assembly 22 preferably includes a circuit board 40 that is performs a variety of functions based upon input received from a control panel 38 that is manipulated by the user. In the preferred embodiment, these functions include the manual energizing of the heater 18, the control of the power provided to the heater 18 in order to vary the temperature of the foot platform 12 based upon user input, the driving of an LED display 52 showing the current temperature level, the operation of the foot sensor, and the automatic de-energizing of the heater 18. However, in other embodiments, the circuit board 40 is eliminated and the electronic assembly 22 only includes an on/off switch and some means for regulating the power from the electrical connector 24 so as to provide a substantially constant flow of power to the heater 18. As explained below in connection with FIGS. 6A through 6E, the preferred circuit board 40 includes a microprocessor 42 that is programmed to serve as a part of the means for automatically de-energizing the heater 18, although it is recognized that other means, such as mechanical timers or the like, may likewise be used for this purpose.

Referring again to FIGS. 1 and 3, the preferred footrest 10 includes a foot sensor 38 in electrical communication with the electronic assembly 22. The foot sensor 38 may take many forms, but each will sense a foot disposed upon the foot platform and send an output signal to the electronic assembly to automatically de-energize the heater 18 when the foot is not disposed upon the foot platform. In the embodiment of FIGS. 1 and 3, the foot sensor 39 is a series of optical sensors 40, 41 that are oriented across a plane formed by the top surface 14 of the foot platform 12 so as to sense the presence of a foot thereon. In the preferred embodiment, these sensors include an infrared light emitter 40 that emits a beam of infrared light and an infrared light receiver 41 that received light from the emitter 40 when a foot is not in contact with the heater. However, the foot sensor 38 may take many forms, including a pressure sensor in communication with the foot platform that is adapted to sense an increase in pressure upon the foot platform when a foot is rested thereon. Accordingly, the foot sensor should not be seen as being limited to the optical sensors described herein.

In embodiments that include a foot sensor 38, the means for automatically de-energizing the heater 18 preferably includes a microprocessor 42 programmed to automatically de-energize the heater 18 when the foot is not disposed upon the top surface 14 of the foot platform 12 for a predetermined period of time. In the preferred embodiment, the microprocessor 42 is programmed to de-energize the heater 18 after the footrest 10 is unused for a consecutive period of fifteen minutes, which allows the user to move from their position and not have to affirmatively de-energize the heater. However, because the foot platform 12 is designed to heat up extremely quickly, this time period may be reduced to one minute or less without sacrificing user comfort.

The preferred microprocessor 42 is also programmed to de-energize the heater 18 if the foot sensor 38 does not detect movement for a specified period of time; preferably fifteen minutes. This is a safety feature that prevents the heater 18 from continuing to operate indefinitely in the event that an object is inadvertently placed on the foot platform 12 in such a manner as falsely trigger the foot sensor 38 and merely requires the user to periodically remove their feet from the foot platform 12 in order to maintain the heater 18 in an energized states.

In the preferred embodiment, the foot sensor 38 also allows the footrest 10 to be automatically reenergized when a user places her foot on the foot platform 12. In such an embodiment, the electronic assembly 22 preferably includes a selector switch that allows the footrest 10 to be turned on, off, or operated in automatic mode. To insure the safety of the footrest 10, this "auto-on" feature is preferably utilized only in those embodiments in which an auto-off feature is likewise included. In these embodiments, the user would need to remove their feet from the foot platform 12 for a predetermined period of time before the heater 18 would be allowed to automatically reenergize.

In embodiments of the footrest 10 in which a foot sensor 38 is not provided, the preferred means for automatically de-energizing the heater 18 is timer that automatically de-energizes the heater 18 after a predetermined period of time. This timer is a safety feature to insure that would insure that accidental placement or dropping of items onto the heater 18 would not result in a fire. The timer may be a mechanical timer, a dedicated electrical component such as a clock chip, or may be a programmed function of a microprocessor 42, which performs other functions in addition to the timing function. The period of time after which the heater 18 is de-energized is preferably between fifteen minutes and two hours and, in some embodiments, may be set by the user. Similarly, the period of time may be calculated from the time that the heater 18 is energized or the time that the temperature has been adjusted.

In some timer based embodiments, an alarm, such as an audible tone or flashing light, is energized before or immediately after the heater 18 is de-energized in order to allow the user to re-set the timer and re-energize the heater 18. Such an alarm may also be used in non-timer based embodiments to alert the user to safe ranges of temperatures for different foot conditions; i.e. bare feet, stocking clad feet, and/or slipper or shoe protected feet. Although one preferred means for automatically de-energizing the heater 18 is a timer, it is recognized that other means, such as ground fault circuit interrupts, tilt switches, temperature switches, or the like, may be added to, or substituted for, the preferred timer. Finally, it is recognized that some embodiments of the footrest 10 may eschew the use of means for automatically de-energizing the heater 18 entirely.

The preferred means for manually energizing and de-energizing the heater 18 is a foot actuatable switch 50. This switch 50 is preferably a two part switch that includes a button actuated electrical component 54 mounted on the circuit board 40 and a membrane 56 located on the control panel 38 proximate to the component 54 such that depressing the membrane 56 causes the component 54 to energize or de-energize the heater 18. However, it is recognized that separate components 54 and membranes 56 may be provided to serve this function. Further, other art recognized switches may be actuated by the foot; including rocker type switches, and lever type switches, or the like, and any of these may be substituted to achieve similar results. Finally, some embodiments of the footrest 10 include means for manually controlling the energizing and de-energizing of the heater 18, such as knobs, dials, or the like, that are not foot actuatable. Therefore, all embodiments of the invention should not be seen as being so limited.

The preferred footrest 10 also includes a means for adjusting a temperature of the foot platform 12. This means preferably takes the form of a first foot actuatable switch 60 for increasing the temperature of the foot platform 12 and a second foot actuatable switch 62 for decreasing the temperature of the foot platform. These switches may take any of the forms of foot actuatable switches discussed above with regard to the on/off switch 50, but are preferably similar two part membrane actuated switches to those of the preferred on/off switch 50. It is preferred that the user be able to adjust the temperature through eight separate temperature settings, with the current temperature setting being displayed on an LED display 52 that is viewable through the control panel 38. However, other embodiments may include lights or sounds to indicate increased or decreased temperature, while still others are not foot actuable or include any display, but rather take the form of a potentiometer with the dial position indicating the power setting. Finally, some embodiments of the footrest 12 have only a single temperature setting, with the desired temperature being pre-set at the factory.

Figure 6A:
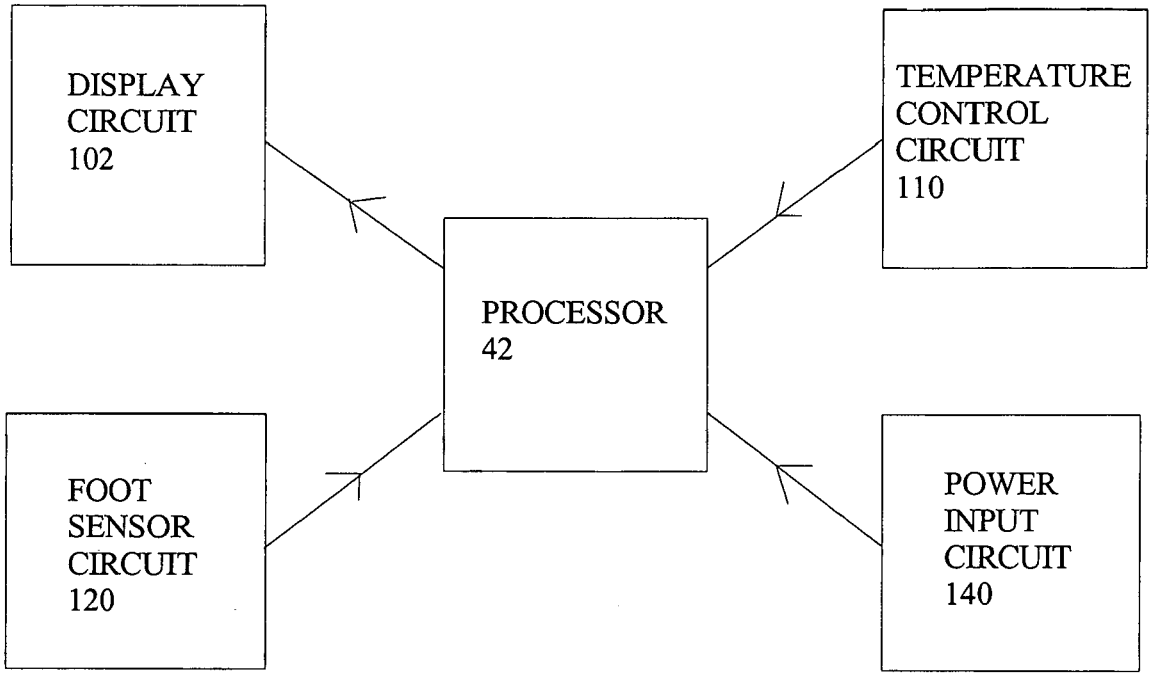
FIG. 6A is a block diagram showing the circuit blocks of one embodiment of the electronic assembly of the heater of the present invention.

Referring now to FIGS. 6A-6E, one embodiment of the electronic assembly 22 is shown. As shown in FIG. 6A, the electronic assembly may be divided into four functional circuit blocks, each of which communicates with the microprocessor. These functional circuit blocks are the display circuit block shown in FIG. 6B, the temperature control circuit block shown in FIG. 6C, the foot detector circuit block shown in FIG. 6D, and the power input circuit block shown in FIG. 6E. It is noted that the circuit diagrams depicted in FIGS. 6B-6E show the circuits used in the prototype of the invention and represent the inventor's current understanding of the best mode for implementing the invention. However, it is understood that a variety of modifications may be made to these circuits and, accordingly, the invention should not be seen as being limited to heaters having the circuits shown and described herein.

Figure 6B:
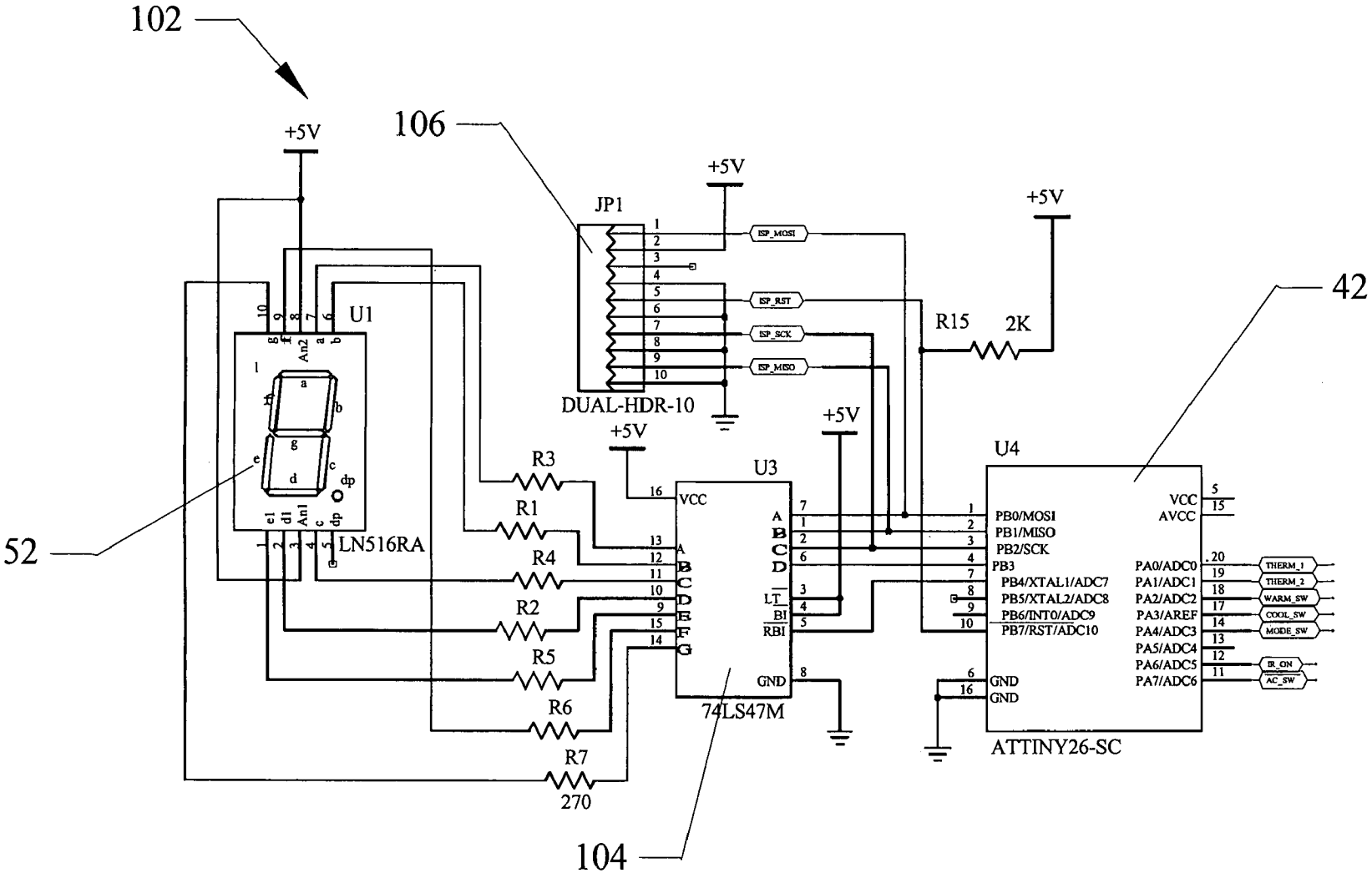
FIG. 6B is a circuit diagram showing the components of one embodiment of the display circuit block and processor of the electronic assembly of FIG. 6A.

FIG. 6B shows the display circuit block 102, which is in communication with the microprocessor 42. The preferred microprocessor is a model ATTINY26-SC microcontroller manufactured by Atmel Corporation of San Jose, Calif. The microprocessor 42 accepts inputs from each of the circuit blocks and sends corresponding outputs based upon the internal programming stored therein. In the case of the display circuit block 102, the microprocessor sends a signal through a header 106, such as a JP1 ten pin header, to a logic controller 104, preferably a dual d-type flip-flop such as part number 74LS47 available from a number of sources, which controls the illumination of the individual LED that make up the LED display 52. The input from the logic controller is sent through resistors 106 in order to insure the proper power input to the LED display 52.

Figure 6C:
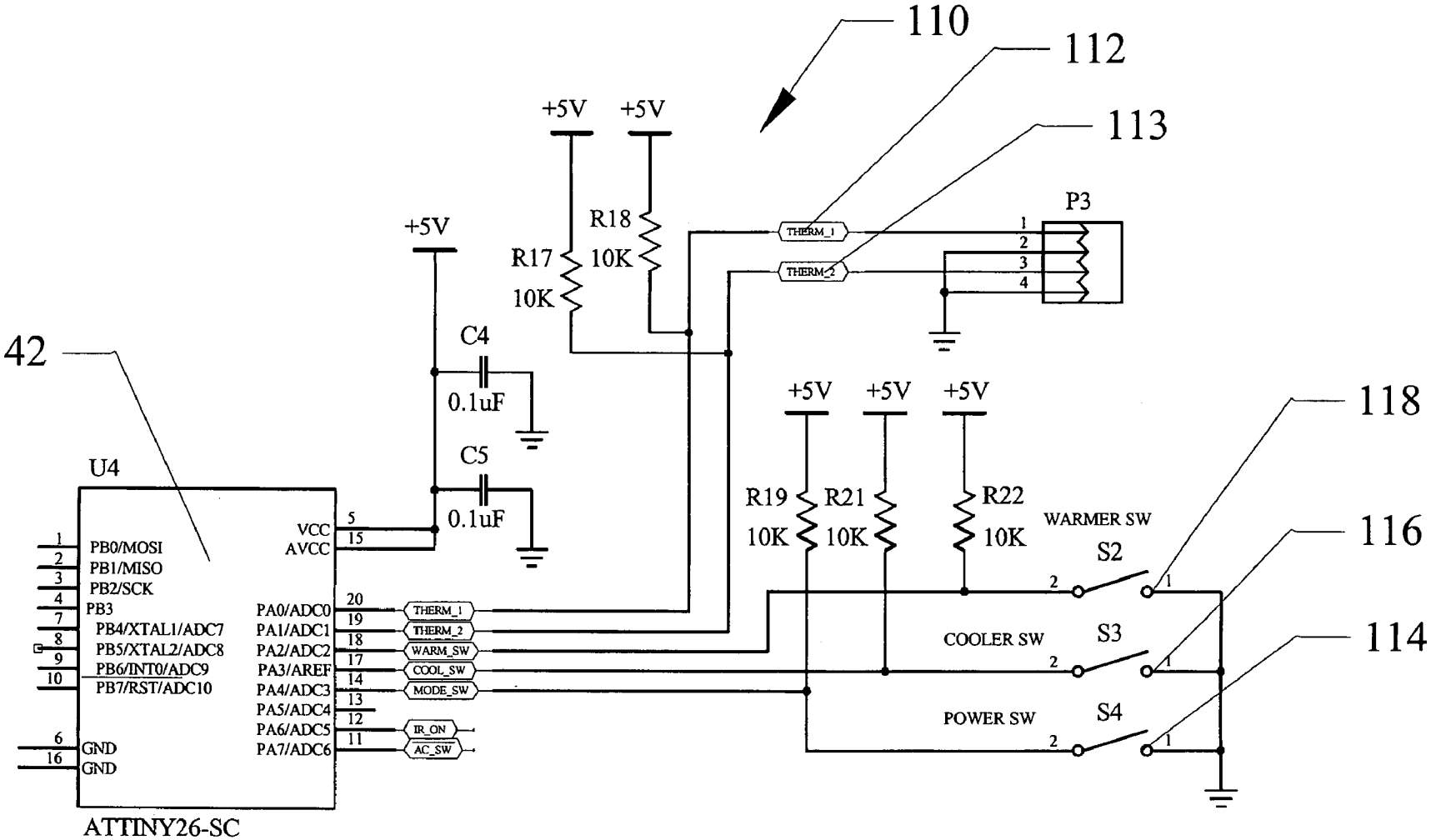
FIG. 6C is a circuit diagram showing the components of one embodiment of the temperature control circuit block and processor of the electronic assembly of FIG. 6A.

FIG. 6C shows the temperature control circuit block 110 in communication with the microprocessor 42. The temperature control circuit block 100 includes a pair of thermistors 112, 113 that are mounted in thermal communication with different portions of the foot platform. The thermistors 112, 113 each send signals to the microprocessor 42 corresponding to the temperatures at the portions of the foot platform to which they are mounted. The microprocessor 42 then processes the signals, determines whether the temperature is too high or too low and send an appropriate signal to the switches 114, 116, 118 in order to stop or start the flow of power to the heater.

Figure 6D:
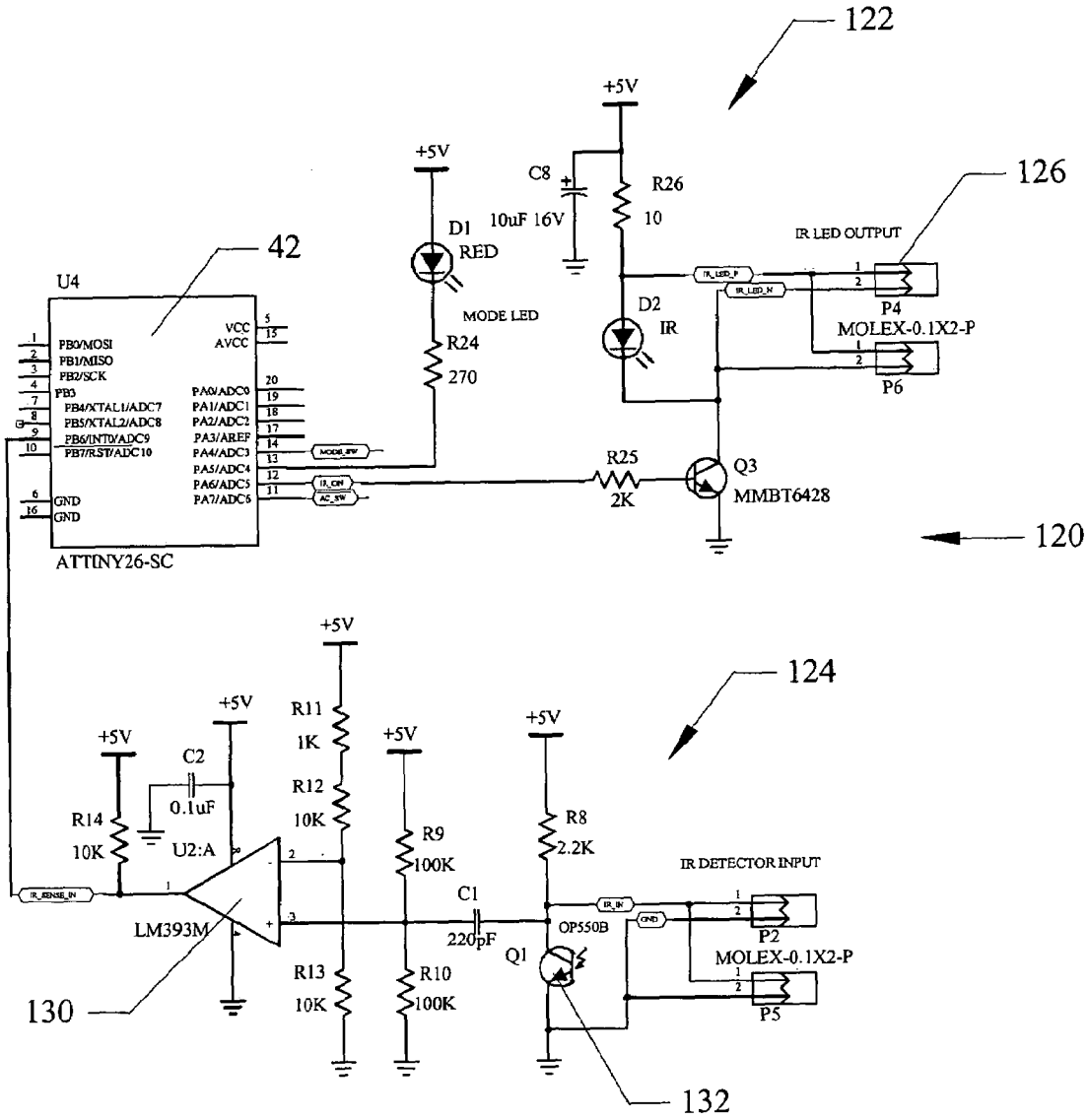
FIG. 6D is a circuit diagram showing the components of one embodiment of the foot detector circuit block and processor of the electronic assembly of FIG. 6A.

FIG. 6D shows the foot detector circuit block 120 in communication with the microprocessor. The foot detector circuit block is made up of two sub-blocks; the IR LED output sub-block 122 and the IR detector sub-block 124. The IR LED output sub-block 122 includes an infrared LED 126 that received regulated power and emits infrared light. The IR detector sub-block includes an infrared detector 132, preferably a model OP550B NPN silicon phototransistor manufactured by Optek Technologies of Carrollton, Tex., which detects the presence and intensity of light and produces a corresponding signal. This signal is then sent through a voltage comparator 130, such as a model LM393M low offset voltage dual comparator manufactured by Motorola, Inc., of Phoenix, Ariz., which determine whether the voltage of the signal represents triggered or untriggered condition and sends an appropriate signal back to the microprocessor 42.

Figure 6E:
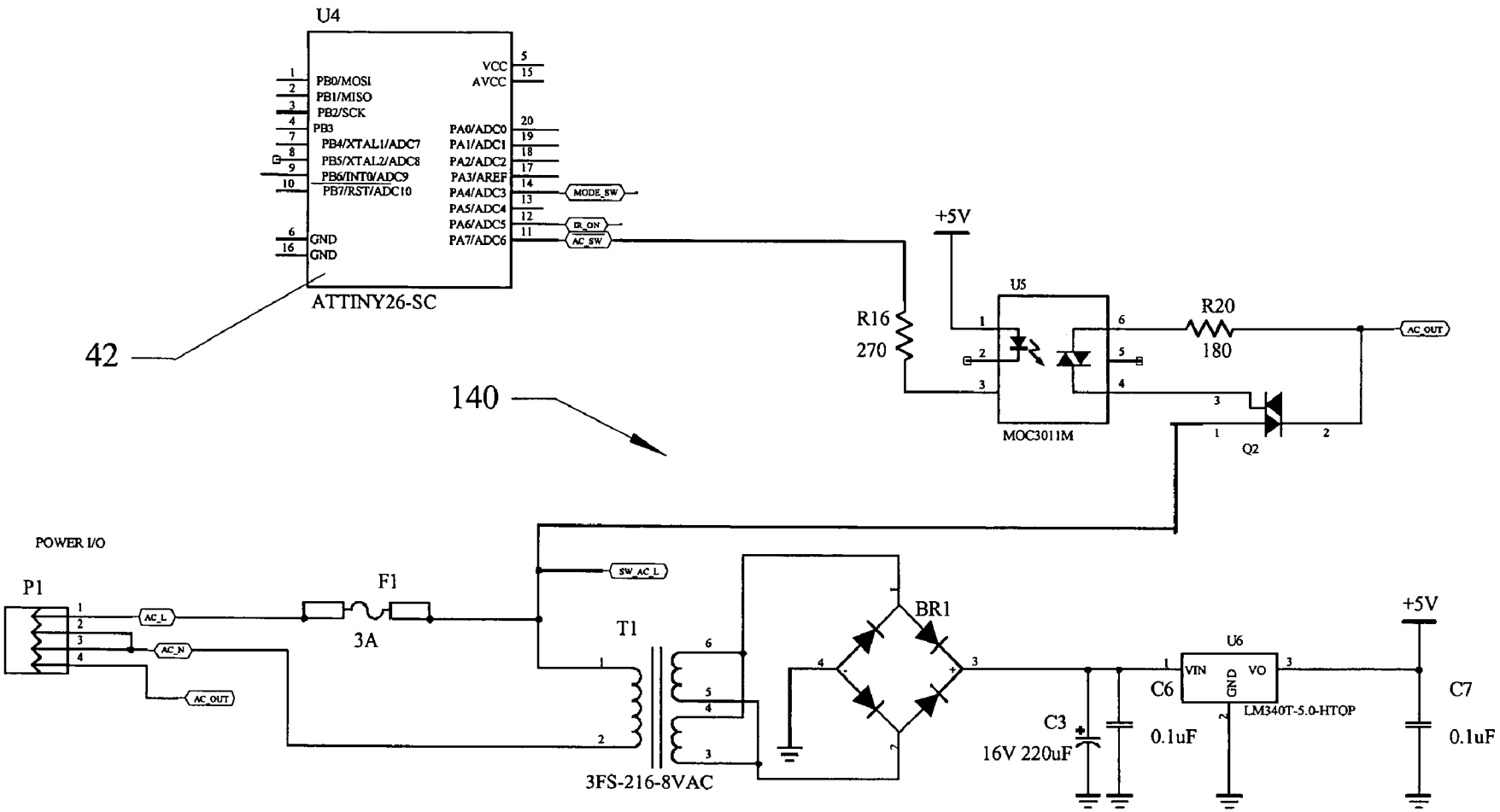
FIG. 6E is a circuit diagram showing the components of one embodiment of the power input circuit block and processor of the electronic assembly of FIG. 6A.

FIG. 6E shows the power input circuit block 140 in communication with the microprocessor. The power input circuit block accepts alternating current from an electrical outlet and transforms this current to the direct current necessary for the operation of the electronic assembly.

Referring again to FIGS. 1 and 3, the housing 20 of the preferred footrest 12 encloses the bottom surface 16 of the foot platform 12 and the heater 18, effectively preventing the heater 18 from coming into contact with the floor. The preferred housing 20 is also adapted to mate with a fascia plate 70 that fits about the perimeter of the top of the housing 20. The preferred fascia plate 70 has a large opening 72 that exposes the top surface 14 of the foot platform 12 and other smaller openings 74, 76 that accommodate the various components of the control panel 38. The bottom edge 78 of the preferred fascia plate 70 includes two padded heel rests 80, which act as ledge upon which the user may rest her heels when using the footrest 10.

Figure 5:
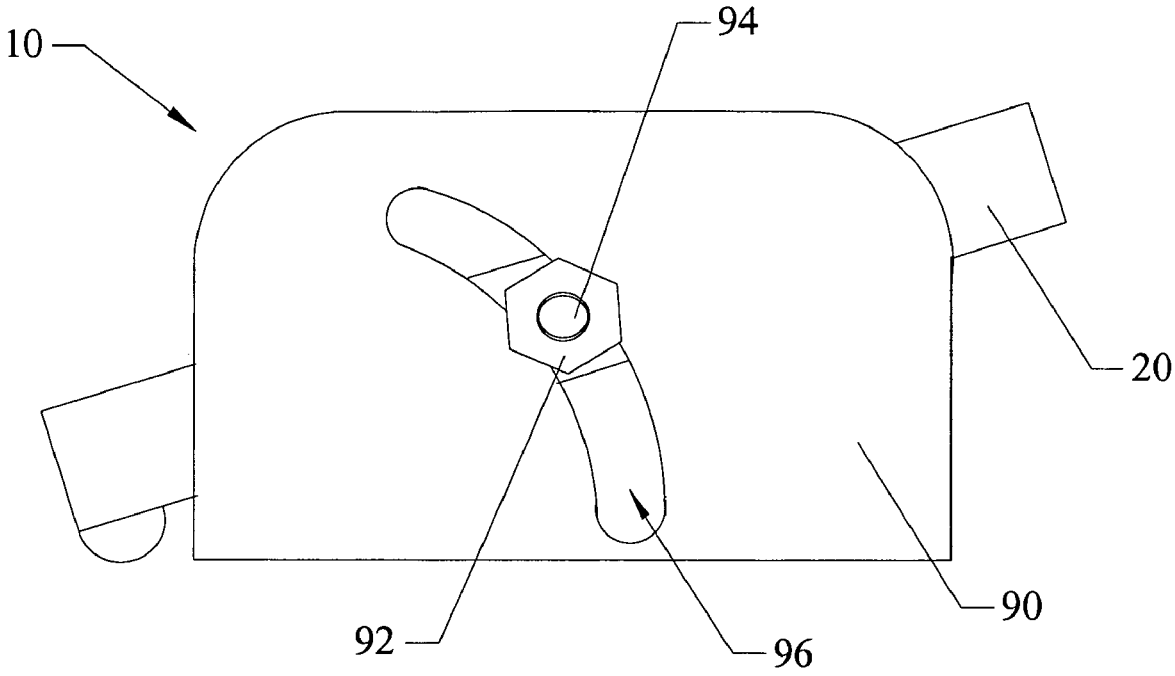
FIG. 5 is a side view of an alternative embodiment of the footrest of the present invention including an angle adjustment.

The preferred housing 20 includes two front feet 82 that are attached directly to the front edge of the housing 20 and two rear feet 84 that attach to a riser 85 that extends from the bottom of the housing 20 at a position toward the rear thereof. The preferred riser 84 is merely a hollow plastic wedge that acts to set the rear of the housing 20 at a position higher than the front of the housing 20. However, as shown in FIG. 5, the angle of the footrest 10 may be adjusted in some embodiments of the invention. FIG. 5 shows a simple adjustment system in which a pair of threaded rods 94 extend from the sides of the housing 20 and through a slot 96 in a side support 90. These rods 94 may be slid to any position within the slot 96 and secured thereto by tightening the threaded knob 92, effectively setting the angle of the footrest 10. However, a wide variety of art recognized angle-adjusting means could be substituted to achieve similar results and, therefore, this feature should not be limited to the embodiment shown in FIG. 5.

Figure 7:
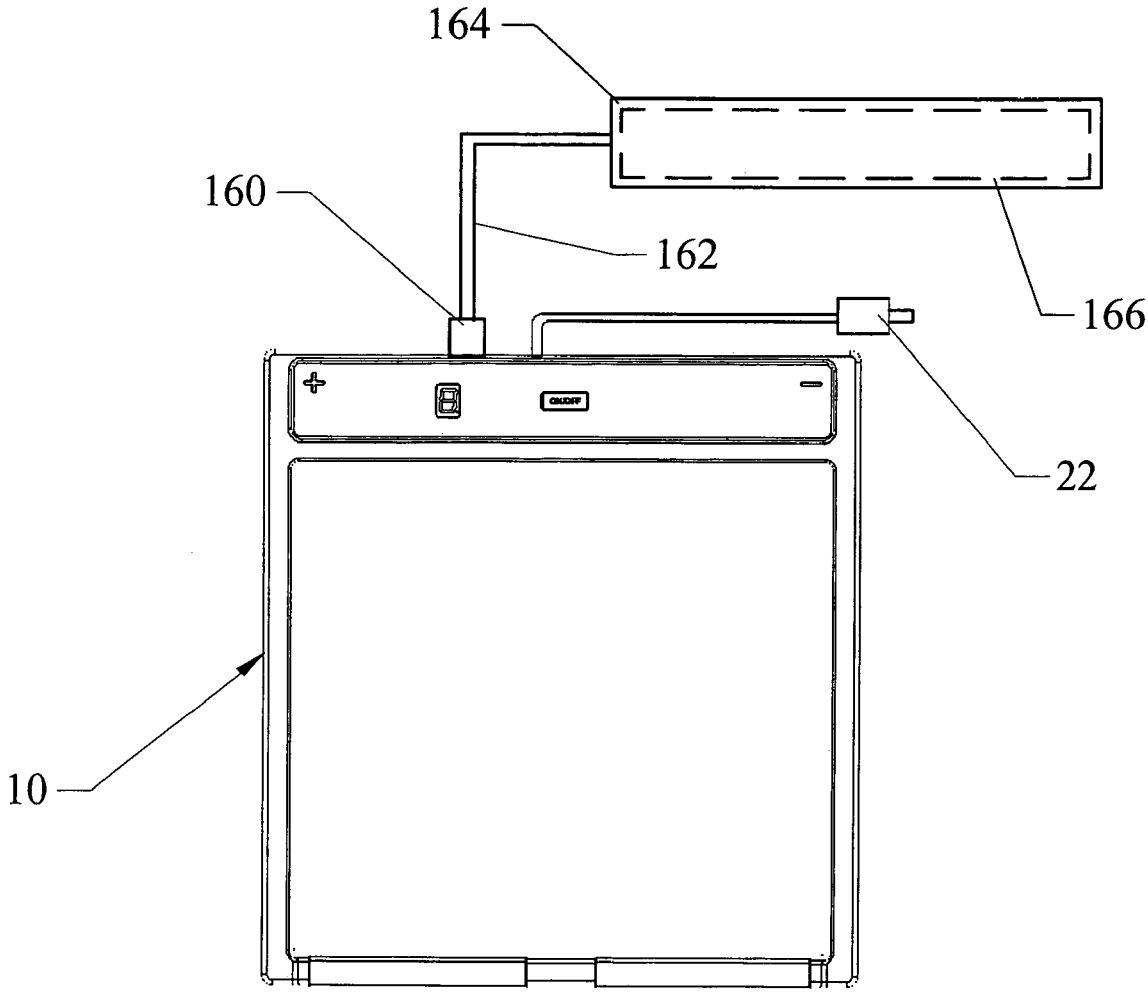
FIG. 7 is a top diagrammatic view of one embodiment of the footrest having an output that controls the operation of a heated wrist pad.

Finally, some embodiments of the heater also include a power output that allows additional heating elements to be controlled by the foot heater. For example, as shown in FIG. 7, the foot heater 10 includes a power output 160 that attaches to a separate wrist heater 164 disposed within a gel-type keyboard wrist pad 166 via a cord 162. It is noted that the cord 162 is shown as being relatively short, but would preferably extend six to nine feet to allow it to extend from a floor to the surface of a users' desk. In such an embodiment, the power supplied to the wrist heater 164 is controlled by the heater 10 and is energized when the foot heater 10 is energized and deenergized when the foot heater 10 is deenergized. Further, the temperature of wrist heater 160 is controlled by the foot heater 10, eliminating the need for separate controls. Accordingly, a user could concurrently warm both her feet and hands using the same unit. However, in other embodiments, the wrist heater 160 includes its own separate plug and temperature controls, is controlled separately from the foot heater and, likely, would be sold separately from the heater itself. Finally, it is noted that, although a gel-type wrist pad 166 is preferred any wrist pad 166 manufactured of a heat conducting material may be utilized.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A portable footrest comprising:

a foot platform comprising a top surface and a bottom surface;

a heater in thermal communication with said top surface of said foot platform;

a housing in supporting relation to said foot platform and said heater, said housing being shaped and dimensioned to maintain said foot platform and said heater above a level of a surface upon which said footrest is placed;

an electronic assembly in electrical communication with said heater, said electronic assembly comprising an electrical connector for connection to an power source, means for manually energizing and de-energizing said heater, and means for automatically de-energizing said heater, and a foot sensor in electrical communication with said electronic assembly, said foot sensor comprising a means for sensing a foot disposed upon said foot platform and output means for sending an output signal to said means for automatically de-energizing said heater indicating when the foot is not disposed upon said foot platform.

2. The footrest as claimed in claim 1 wherein said means for automatically de-energizing said heater comprises a microprocessor, and wherein said microprocessor is programmed to automatically de-energize said heater when said output signal from said foot sensor indicates that the foot is not disposed upon said foot platform for a predetermined period of time.

3. The footrest as claimed in claim 2 further comprising means for automatically reenergizing said heater when said output signal from said foot sensor indicates that the foot is disposed upon the foot platform.

4. The footrest as claimed in claim 1 wherein said foot sensor comprises at least one optical sensor oriented across a plane formed by said foot platform.

5. The footrest as claimed in claim 1 wherein said foot sensor comprises a pressure sensor in communication with said foot platform and adapted to sense an increase in pressure upon said foot platform.

6. The footrest as claimed in claim 1 wherein said means for manually energizing and de-energizing said heater comprises a foot actuatable switch.

7. The footrest as claimed in claim 1 wherein said electronic assembly further comprises a means for adjusting a temperature of said foot platform.

8. The footrest as claimed in claim 7 wherein said means for adjusting a temperature of said foot platform comprises at least one foot actuatable switch.

9. The footrest as claimed in claim 8 wherein said at least one foot actuatable switch comprises a first foot actuatable switch for increasing said temperature of said foot platform and a second foot actuatable switch for decreasing said temperature of said foot platform.

10. The footrest as claimed in claim 1 wherein said housing comprises a means for adjusting an angle of said foot platform.

11. The footrest as claimed in claim 1 wherein said foot platform comprises a substantially rectangular sheet of a thermally conductive metal material having a thickness of less then 0.25 inches.

12. The footrest as claimed in claim 11 wherein said heater is an electrical resistance heater having a thickness of less then 0.025 inches and wherein said electrical resistance heater is attached to at least fifty percent of said bottom surface of said foot platform.

13. The footrest as claimed in claim 1 further comprising a power output and a wrist heater in communication with said power output.

14. A portable footrest comprising:

a foot platform manufactured of a thermally conductive material, said foot platform comprising a top surface and a bottom surface;

a heater in thermal communication with said top surface of said foot platform;

a housing in supporting relation to said foot platform and said heater, said housing being shaped and dimensioned to maintain said foot platform and said heater above a level of a surface upon which said footrest is placed; and an electronic assembly in electrical communication with said heater, said electronic assembly comprising an electrical connector for connection to an power source and means for energizing and de-energizing said heater;

wherein said heater is a thermoelectric module and wherein said electronic assembly comprises means for reversing a flow of direct current though said thermoelectric module.

15. The footrest as claimed in claim 14 wherein said electronic assembly further comprises means for automatically de-energizing said electrical resistance heater.

16. The footrest as claimed in claim 15 wherein said means for automatically de-energizing said electrical resistance heater comprises at least one foot sensor in electrical communication with said electronic assembly, said at least one foot sensor comprising a means for sensing a foot disposed upon said foot platform and output means for sending an output signal to said means for automatically de-energizing said heater indicating when the foot is not disposed upon said foot platform.

17. The footrest as claimed in claim 16 wherein said means for automatically de-energizing said heater comprises a microprocessor, and wherein said microprocessor is programmed to automatically de-energize said heater when said output signal from said foot sensor indicates that the foot is not disposed upon said foot platform for a predetermined period of time.

18. The footrest as claimed in claim 16 further comprising means for automatically reenergizing said heater when said output signal from said foot sensor indicates that the foot is disposed upon the foot platform.

19. The footrest as claimed in claim 16 wherein said foot sensor comprises at least one optical sensor oriented across a plane formed by said foot platform.

20. The footrest as claimed in claim 15 wherein said electronic assembly further comprises a means for adjusting a temperature of said foot platform.

21. The footrest as claimed in claim 15 further comprising a power output and a wrist heater in communication with said power output.

22. A portable footrest comprising:

a foot platform manufactured of a thermally conductive material, said foot platform comprising a top surface and a bottom surface;

a heater in thermal communication with said top surface of said foot platform;

a housing in supporting relation to said foot platform and said heater, said housing being shaped and dimensioned to maintain said foot platform and said heater above a level of a surface upon which said footrest is placed;

an electronic assembly in electrical communication with said heater, said electronic assembly comprising an electrical connector for connection to an power source, a means for energizing and de-energizing said heater, and a power output; and a wrist heater in communication with said power output.

23. The footrest as claimed in claim 22 further comprising a keyboard wrist pad manufactured of a heat conducting material, wherein said wrist heater is disposed within said wrist pad.

24. The footrest as claimed in claim 22 wherein said electronic assembly controls a temperature of said heater and said wrist heater.

* * * * *